US010988969B1

(12) United States Patent
Harley

(10) Patent No.: US 10,988,969 B1
(45) Date of Patent: Apr. 27, 2021

(54) SCREENING APPARATUS AND ASSEMBLY

(71) Applicant: Theron Clark Harley, Mendota Heights, MN (US)

(72) Inventor: Theron Clark Harley, Mendota Heights, MN (US)

(73) Assignee: THERON CLARK HARLEY

( * ) Notice: Subject to any disclaimer, the term of this patent is extended or adjusted under 35 U.S.C. 154(b) by 198 days.

(21) Appl. No.: 16/155,485

(22) Filed: Oct. 9, 2018

(51) Int. Cl.
*E06B 3/40* (2006.01)
*E06B 9/24* (2006.01)
*E05D 15/02* (2006.01)

(52) U.S. Cl.
CPC ..... *E06B 3/40* (2013.01); *E05D 15/02* (2013.01); *E06B 9/24* (2013.01); *E06B 2003/406* (2013.01)

(58) Field of Classification Search
CPC ..... E06B 2003/406; E06B 3/40; E05D 15/02
See application file for complete search history.

(56) References Cited

U.S. PATENT DOCUMENTS 1,893,128 A * 1/1933 Calvert ..... E05C 17/18 49/356
2,888,718 A * 6/1959 Gilles-Joseph Francotte ..... E06B 3/12 49/504
3,916,774 A 11/1975 LaBrec
4,368,603 A * 1/1983 Dumas ..... E06B 3/00 49/371
4,999,948 A * 3/1991 Hodgens ..... E06B 7/084 49/74.1
5,052,150 A * 10/1991 Chen ..... E06B 7/084 454/224
5,173,993 A * 12/1992 Baker ..... E05D 11/087 16/329
5,408,726 A * 4/1995 Kent ..... E05D 11/1007 16/320
5,878,463 A * 3/1999 Kluting ..... E05D 11/1085 16/322
6,233,888 B1 * 5/2001 Wu ..... E05D 15/0678 16/104
7,175,227 B2 * 2/2007 Menard ..... E05F 15/43 296/146.1
7,571,896 B2 * 8/2009 Bonham ..... E04H 4/06 256/26
7,740,047 B2 * 6/2010 Koop ..... E06B 9/50 160/323.1
8,302,938 B2 11/2012 Ebeling
8,713,857 B2 * 5/2014 Logue ..... A47B 46/005 160/200

(Continued)

*Primary Examiner* — Catherine A Kelly
(74) *Attorney, Agent, or Firm* — Crawford Maunu PLLC

(57) ABSTRACT

Aspects of the present disclosure are directed to apparatuses and related methods involving a screening apparatus and assembly. As may be implemented in accordance with one or more embodiments, an apparatus includes a plurality of panels, a frame and, for each panel, a locking mechanism coupled to the frame and a mechanical actuator connected to the panel and the frame. The locking mechanism locks the panel in place when engaged with the panel, and may do so at a different angle of rotation, relative to the other panels. The mechanical actuator positions the panel relative to the frame and offset from the other panels, and facilitates rotation of the panel about an axis of rotation that is fixed relative to the frame, in response to the panel being disengaged from the locking mechanism.

19 Claims, 9 Drawing Sheets

(56) References Cited

U.S. PATENT DOCUMENTS

| | | | | |
|---|---|---|---|---|
| 9,212,514 | B2 * | 12/2015 | Joray | E06B 7/18 |
| 9,316,042 | B2 * | 4/2016 | Goldenberg | E06B 3/5054 |
| 9,822,570 | B2 * | 11/2017 | Jaranson | E05C 17/203 |
| 10,514,730 | B2 * | 12/2019 | Delpier | G06F 1/1679 |
| 2011/0147688 | A1 | 6/2011 | Esposito | |
| 2012/0304549 | A1 | 12/2012 | Rutledge | |
| 2015/0345173 | A1 | 12/2015 | Grasman | |
| 2017/0002604 | A1 * | 1/2017 | Andrus | E05F 15/611 |
| 2017/0130461 | A1 * | 5/2017 | Ebeling | E04F 11/1817 |
| 2017/0159322 | A1 | 6/2017 | Presti | |
| 2018/0266169 | A1 * | 9/2018 | Wray | E06B 3/7015 |
| 2018/0305969 | A1 * | 10/2018 | Docksteader | E05F 15/72 |
| 2019/0078367 | A1 * | 3/2019 | Xiao | E05D 15/26 |

* cited by examiner

SCREENING APPARATUS AND ASSEMBLY

OVERVIEW

Various aspects of the disclosure are directed to screening apparatuses and assemblies, as well as methods therefor.

Certain screening structures such as those involving louvers or jalousies, and their related apparatuses have been very useful for a variety of purposes. For instance, such structures can be useful for providing shade, blocking light, providing privacy, directing the flow of fluid such as air or water (e.g., rain), providing enhanced aesthetics, facilitating ventilation, and more. In general, louvers are arranged in sets, with each louver having flat or curved surfaces that are fixed or may rotate along a central axis between open and closed positions. Louvers may be made of a variety of materials, including plastics, woods, glass, ceramics, and metals. Louvers may be implemented in a variety of applications, such as with window blinds, within windows, in agricultural or industrial ventilation, ventilating closed spaces such as attics, shielding views, and more.

Some louvers are fixed and others move, such as by rotating. Operation of louvers that rotate may be carried out using a fixed structure mounted to each louver and operable to move groups of louvers together. The rotation of sets of louvers is typically carried out by coupling the louvers together, and rotating one or more of the louvers in a manner that causes all louvers to rotate simultaneously. In this context, the axis about which respective louvers rotate moves freely, to facilitate such movement. Cables and pulleys, operated manually or via motorized operators, can be used to effect rotation of the sets of louvers.

While louvers have been very useful for a multitude of applications, specific positioning of the louvers can be challenging to achieve. Louvers that rotate desirably do so freely so that movement of a set of louvers in unison can be carried out with ease. However, positioning in this regard can be limited, and certain louvers may be susceptible to operational failure. For instance, when subjected to fluid pressure and/or flow (e.g., airflow in an exterior environment), louvers can be difficult to maintain in position. These and other issues have presented challenges to obtaining accurate measurements, in a variety of disparate applications.

SUMMARY

Aspects of various embodiments are directed to screen hardware and assemblies, such as those involving individually-controlled louvers.

Various embodiments are directed to an apparatus having a plurality of panels, a frame, and for each panel, a locking mechanism coupled to the frame and configured and arranged to lock the panel in place when engaged with the panel, and a mechanical actuator. Each panel and its corresponding locking mechanism are configured and arranged to lock the panel in place at a different angle of rotation, relative to the other panels. The mechanical actuator for each panel is connected to the panel and to the frame, and configured and arranged with the panel and frame to position the panel relative to the frame and offset from the other panels by a distance that is sufficient for adjacent ones of the panels to rotate independently of one another. The mechanical actuator is also configured to, in response to the panel being disengaged from the locking mechanism, facilitate rotation of the panel about an axis of rotation that is fixed relative to the frame.

The above discussion/summary is not intended to describe each embodiment or every implementation of the present disclosure. The figures and detailed description that follow also exemplify various embodiments.

DESCRIPTION OF THE FIGURES

Various example embodiments may be more completely understood in consideration of the following detailed description in connection with the accompanying drawings, in which:

FIGS. 5A and 5B show a screening apparatus in which FIG. 5A shows a frame and top view, and FIG. 5B shows a perspective view with panels in various positions, as may be implemented in accordance with one or more embodiments;

Figure 1:
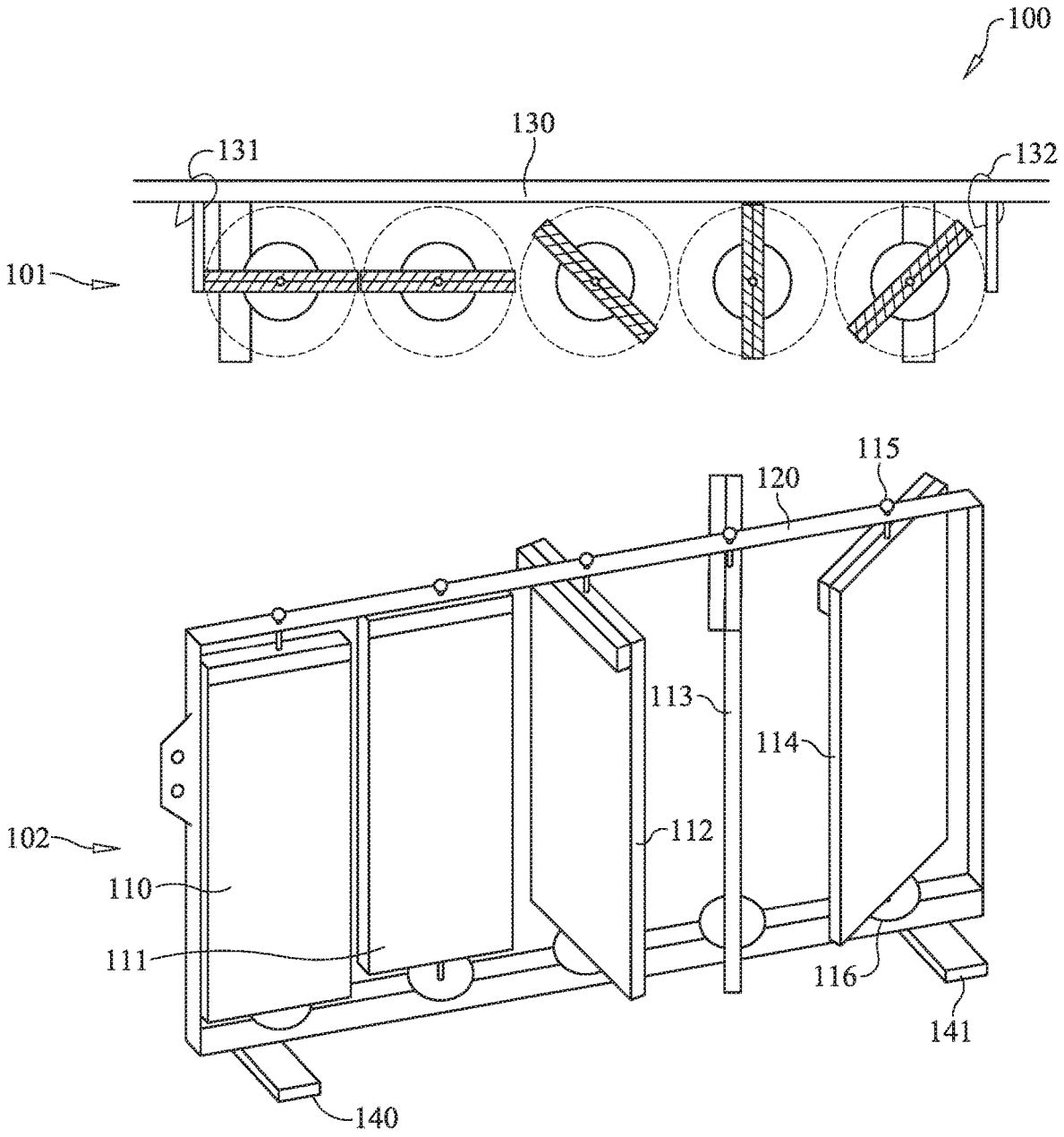
FIG. 1 shows a screening apparatus, as may be implemented in accordance with one or more embodiments

While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims. In addition, the term "example" as used throughout this application is only by way of illustration, and not limitation.

DETAILED DESCRIPTION

Aspects of the present disclosure are believed to be applicable to a variety of different types of apparatuses, systems and methods involving louvers and related components. In certain implementations, aspects of the present disclosure have been shown to be beneficial when used in the context of positioning individual louvers for a variety of applications. Certain embodiments involve a temporary screening apparatus that can be used for applications including balconies, decks and patios. The apparatus has individual screening panels that rotate somewhat or fully independently of each other, where each screen panel is temporarily set into a fixed position via a positioner. While not necessarily so limited, various aspects may be appreciated through a discussion of examples using such exemplary contexts.

According to various example embodiments, aspects of the present disclosure are directed to a screening apparatus having individual screening panels that rotate independently of one another (e.g., 360°). Adjacent ones of the screening panels may be offset equally or at varied distances. Each screen panel is temporarily set into a fixed position via a positioner and can be adjusted accordingly. In some implementations, an array of such screen panels can be located within a rigid frame. Such a frame may be temporarily secured to a railing. The size and configuration of the screening apparatus can be determined by the user. The panels, positioner (and where applicable, frame) may be configured such that setup, operation, and disassembly can be carried out by hand, without requiring tools.

Various embodiments are directed toward screening applications such as those useful in residential buildings and complexes that incorporate balconies, patios, and decks as an amenity. Such embodiments may address challenges such as those characterized in the background above. For instance, screening apparatuses implemented in accordance with one or more embodiments herein may be utilized in structures such as balconies, patios, and decks, which can provide privacy when located in close proximity while facilitating air flow and solar shade, when so desired. For instance, individually-controlled louvers can be positioned to provide privacy screening to a certain region of a balcony, patio or deck, while others can be positioned to allow airflow or solar shade.

Individually-controlled louvers can be utilized in different environments and throughout various seasons. Using a south facing, top floor balcony on a four story building as an example, a user may wish to block sun or wind yet retain the view, or may want complete privacy while directing wind towards an open patio door.

Accordingly, various embodiments are directed to a screening apparatus for patios, balconies, porches, decks, or anywhere a railing is deployed, to provide privacy, control airflow, provide solar screening, block out of objectionable views, or block unwanted illumination from streets, parking lots, security lights, or electric signs and billboards that can be readily adjusted to suit changing needs.

In some implementations, such a screening apparatus is portable, such that it is easily moved or transported. For instance, the screening apparatus may be sized such that it can be installed in buildings having small elevators, narrow stairwells, hallways, or doors. Such an individual screening apparatus can be configured in a manner that meets the screening needs of specific users, doesn't require any tools for assembly or disassembly, and is simple to operate. The resulting design may be tailored to suit various requirements as a temporary screening apparatus for balconies, decks and patios. For instance, a framed set of screening panels can be temporarily secured to a balcony railing for screening purposes, and moved as desired.

Various embodiments are directed to an apparatus having a plurality of panels, a frame and, for each panel, a locking mechanism coupled to the frame and a mechanical actuator connected to the panel and frame. Each panel and its corresponding locking mechanism and mechanical actuator are operable to lock the panel in place, and to do so (if desired) at a different angle of rotation, relative to the other panels. The mechanical actuator is connected to the panel and to the frame, and configured with the panel and frame to position the panel relative to the frame and offset from the other panels by a distance that is sufficient for adjacent ones of the panels to rotate independently of one another. The mechanical actuator also facilitates rotation of the panel about an axis of rotation that is fixed relative to the frame, in response to the panel being disengaged from the locking mechanism.

The locking mechanisms may be implemented in a variety of manners. In some embodiments, at least one of the locking mechanisms includes a shape feature configured to engage with a corresponding shape feature of the panel to which it is configured to engage, for locking the position of the panel relative to the locking mechanism. The locking mechanism may be configured to move toward and away from its panel respectively for engaging and disengaging with the panel. In some embodiments, the respective locking mechanisms for each panel engage with and lock their respective panels independent of engaging and locking of the other panels with the respective locking mechanisms of the other panels.

Each panel and its corresponding mechanical actuator and locking mechanism may be implemented in a variety of manners. In some embodiments, the mechanical actuator and locking mechanism for each panel facilitate engaging and disengaging of the panel and the locking mechanism via relative movement between the panel and the locking mechanism. Each panel may move respectively toward and away from its locking mechanism via the mechanical actuator connected to the panel for engaging and disengaging with the locking mechanism. Further, each panel and its corresponding locking mechanism may move toward and away from each other respectively for engaging and disengaging with one another. Each panel may be configured to move vertically along the mechanical actuator connected thereto for engaging and disengaging the panel with the locking mechanism.

In some embodiments involving a particular panel, the mechanical actuator includes a shaft along which the panel to which it is connected is configured to move, and the locking mechanism is located adjacent a lower portion of the frame and below the panel. The panel is configured to disengage with the locking mechanism in response to being lifted upward along the mechanical actuator for rotation thereof, and to reengage with the locking mechanism and lock in place upon being moved downward along the mechanical actuator and therein engaging with the locking mechanism. With this approach, the panels may be individually adjusted by hand, to provide shade, wind-blocking, or visual privacy, in a readily adjustable manner (e.g., by hand).

In various embodiments, mechanical components may be utilized to assist locking and adjustment of individual panels as characterized herein. In some embodiments, a spring is coupled to one or more panels, with the spring being configured to maintain its panel and the corresponding locking mechanism in an engaged position by applying a spring force. The spring facilitates disengaging of the panel from its corresponding locking mechanism in response to an external force applied to the spring (e.g., moving against the spring force). In other embodiments, a spring is coupled to the frame and configured and arranged to apply a spring force to a panel for engaging the panel with its corresponding locking mechanism, and to facilitate disengaging of the panel in response to the panel being lifted or pushed against the spring.

In further embodiments, one or more springs are coupled to respective locking mechanisms and to the frame, and apply a spring force to the respective locking mechanisms for engaging each locking mechanism with its corresponding panel. The spring facilitates disengaging of the locking mechanism from the panel in response to the locking mechanism being lifted or pushed against the spring.

Various methods involving the apparatuses herein may be implemented, such as for the manufacture or use of the apparatus. In some embodiments, a method of manufacturing an apparatus, involves providing a plurality of panels and a frame, and for each panel, coupling a locking mechanism to the frame. The locking mechanism is configured to lock the panel in place when engaged with the panel, and may do so at a different angle of rotation, relative to the other panels. For each panel, a mechanical actuator is connected to the panel and to the frame and configured therewith to position the panel relative to the frame and offset from the other panels by a distance that is sufficient for adjacent ones of the panels to rotate independently of one another, and to facilitate rotation of the panel about an axis of rotation that is fixed relative to the frame in response to the panel being disengaged from the locking mechanism. One or more of the locking mechanisms may include a shape feature configured to engage with a corresponding shape feature of the panel to which it is configured to engage, for locking the position of the panel relative to the locking mechanism. The mechanical actuator and locking mechanism for each panel may be configured to facilitate engaging and disengaging of the panel and the locking mechanism via relative movement between the panel and the locking mechanism.

In some embodiments, the aforementioned method of manufacturing involves, for each panel, providing the mechanical actuator with a shaft along which the panel to which it is connected is configured to move, and locating the locking mechanism adjacent a lower portion of the frame and below the panel. The panel is configured to disengage with the locking mechanism in response to being lifted upward along the mechanical actuator for rotation thereof, and to reengage with the locking mechanism and lock in place upon being moved downward along the mechanical actuator and therein engaging with the locking mechanism.

In another embodiment, a method of using a screening apparatus having a plurality of panels is carried out as follows. For each of the panels, a locking mechanism to a frame and used to lock the panel in place when engaged with the panel. Different ones of the panels may be locked in place at a different angle of rotation, relative to the other panels. A mechanical actuator is connected to each panel and to the frame, and used therewith to position the panel relative to the frame and offset from the other panels by a distance that is sufficient for adjacent ones of the panels to rotate independently of one another, and to facilitate rotation of the panel about an axis of rotation that is fixed relative to the frame in response to the panel being disengaged from the locking mechanism. In some embodiments, a shape feature of the locking mechanism for at least one of the panels is used to engage with a corresponding shape feature of the panel and therein lock the position of the panel relative to the locking mechanism. One of more panels may be engaged and disengaged from its corresponding locking mechanism via relative movement between the panel and the locking mechanism.

In a particular embodiment involving the aforementioned method of use, the mechanical actuator includes a shaft along which the panel to which it is connected is configured to move, and the locking mechanism is located adjacent a lower portion of the frame and below the panel. One or more of the panels are disengaged from its locking mechanism by lifting the panel upward along the mechanical actuator, rotating the panel, and reengaging the panel with the locking mechanism and locking in place by moving the panel downward along the mechanical actuator and therein engaging with the locking mechanism.

Turning now to the figures, FIG. 1 shows a screening apparatus 100, with a top view 101 and perspective view 102, in accordance with one or more embodiments. The apparatus 100 includes a plurality of screening panels 110, 111, 112, 113 and 114 mounted to a frame 120. Referring to screening panel 114 by way of example, each respective screening panel is operable to rotate about a shaft 115 extending from a top rail of the frame 120, through the screening panel and to a positioner 116 at a bottom rail of the frame. As shown in the top view 101, each panel may rotate up to 360 degrees, for particular embodiments. Other embodiments may involve a limited amount of rotation, to suit particular applications.

Each of screening panels 110, 111, 112, 113 and 114 is configured with its respective positioner for rotation and positioning independently from the other screening panels, and locking in place accordingly. Referring to screening panel 111, each panel is operable with its respective shaft for moving vertically relative to the positioning shown, toward the top rail of frame 120. Moving the screening panel 111 vertically in this regard disengages the panel from its underlying positioner (e.g., 116 for panel 114), allowing the panel to rotate. When the panel is returned to the lowered position, it re-engages with its position and becomes fixed in the position at which it is lowered.

The apparatus 100 can be utilized as a free-standing screen, and may also be fixed to a structure, to suit particular applications. Referring to top view 101, the apparatus 100 is shown secured to a railing 130 via temporary attachment component (e.g., screw or clamp) at 131 and 132. Referring to both top view 101 and side view 102, the apparatus may also include bottom supports 140 and 141, which can be used to provide a stand-alone unit or used in conjunction with other mounts (e.g., screws or clamps) as recited above. Accordingly, the apparatus 100 may be implemented such that assembly and attachment (where applicable) can be carried out by hand (without tools). With flexible implementation, the apparatus 100 can be utilized for temporary or permanent screening for a variety of applications, such as patios, balconies and decks.

Figure 2:
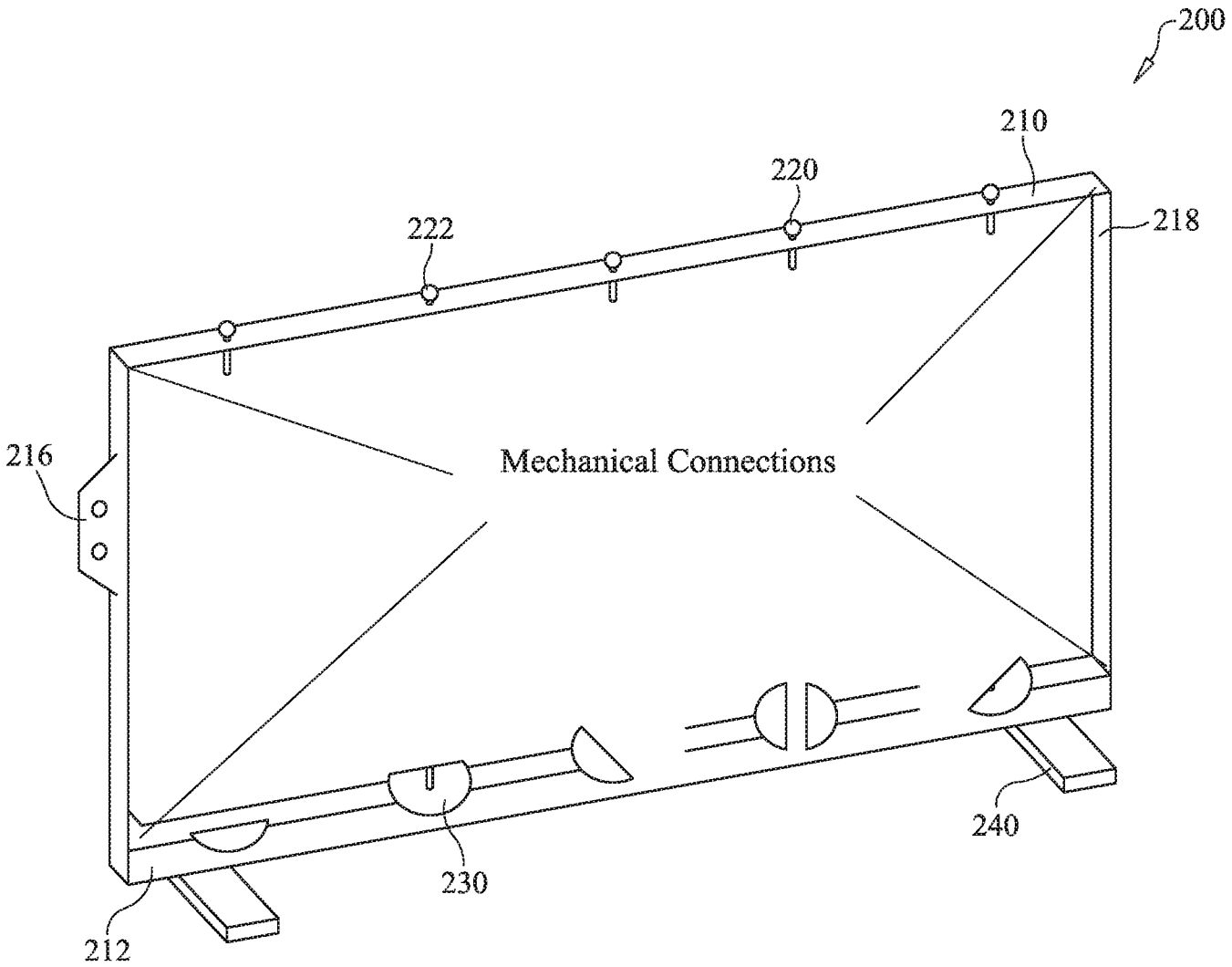
FIG. 2 shows a screening apparatus frame and related locking mechanisms, as may be implemented in accordance with one or more embodiments.

FIG. 2 shows a screening apparatus frame 200 and related locking mechanisms, as may be implemented in accordance with one or more embodiments. The frame 200 may, for example, be implemented with the apparatus 100 shown in FIG. 1. The frame 200 includes a top rail 210, bottom rail 212, and stiles 214 and 216 having panel guards. A plurality of pins (including 220) and pin guides (including 222) are located in the top rail 210, and a plurality of positioners (230 labeled by way of example) are located on the bottom rail 212.

Corners of the frame where the stiles 214 and 216 meet the top rail 210 or bottom rail 212 may be secured mechanically as indicated, which may involve a fastener, adhesive or other securing approach. For instance, the corners may be fitted with pins and recessed pin slots with a pin and slot in those respective pieces to be secured to one another. The corners may also be fitted with other hand-securable components, such as with cotter pins or other mechanisms that can be engaged and disengaged by hand, without necessarily utilizing tools.

The manner of attaching panels and frame components can vary to suit needs and/or available materials. For instance, connectors other than pins, such as roller bearings, geared connectors and others, may be utilized to connect that panels to the frame. Further, while gravity can be used to move panels to a locked position, a spring or other assistance can also be used. In addition, the positioners may be moved to engage/disengage with the panels, which allows the panels to be fixed vertically (if desired). Further, the pins and positioners can be flipped from top to bottom. In such an arrangement, the positioners may be configured for moving upward vertically for disengaging from panels and allowing them to move freely, and then securing the panels upon moving downward to engage therewith. The panels may be operable for moving downward and away from the positioners, such as by using a spring to otherwise engage the panel by moving it toward an overhead positioner. In certain embodiments, the positioners are operable for movement vertically down and away from the panels. Such an approach may, for example, involve utilizing a spring mechanism that maintains the positioners in an upper position and engaged with the panels, and then in response to a downward force (e.g., applied by a user's hand), disengages from the panels and therein allowing them to rotate until the downward force is released and the positioners re-engage with the panels.

Figure 3:
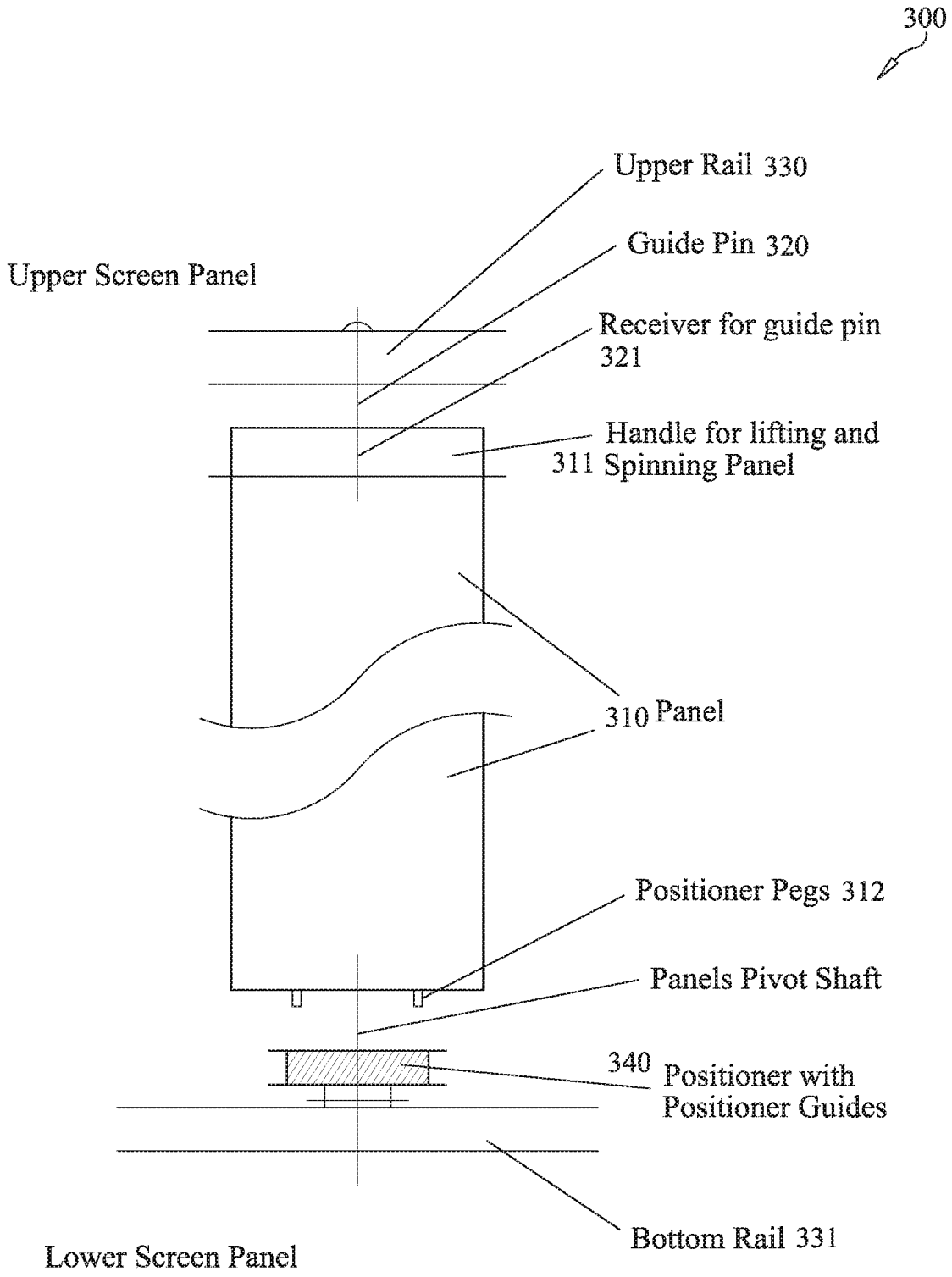
FIG. 3 shows a screening panel apparatus, as may be utilized with one or more embodiments herein.

FIG. 3 shows a screening panel apparatus 300 including an actuator and locking mechanism for positioning a screening panel 310 relative to a frame, as may be utilized with one or more embodiments herein. The actuator includes a guide pin 320 and a receiver 321 for the guide pin (e.g., mounted to panel 310), and is mounted to an upper rail 330 of a frame for facilitating rotation of the panel 310 relative to the frame. The panel 310 may include a built-in handle 311, which may facilitate lifting and rotating of the panel.

The locking mechanism is (or includes) a positioner 340 having positioner guides for engaging with positioner pegs 312 of the panel 310. The positioner guides may, for example, include holes in positioner 340 that are configured to accept the positioner pegs 312 for locking the panel 310 at various degrees of rotation. The positioner 340 is coupled to a bottom rail 331 of the frame, and together with the top rail 330 and guide pin 320, operates to maintain the panel 310 positioned relative to the frame and at a rotational position set via the positioner and positioner pegs 312.

Figure 4:
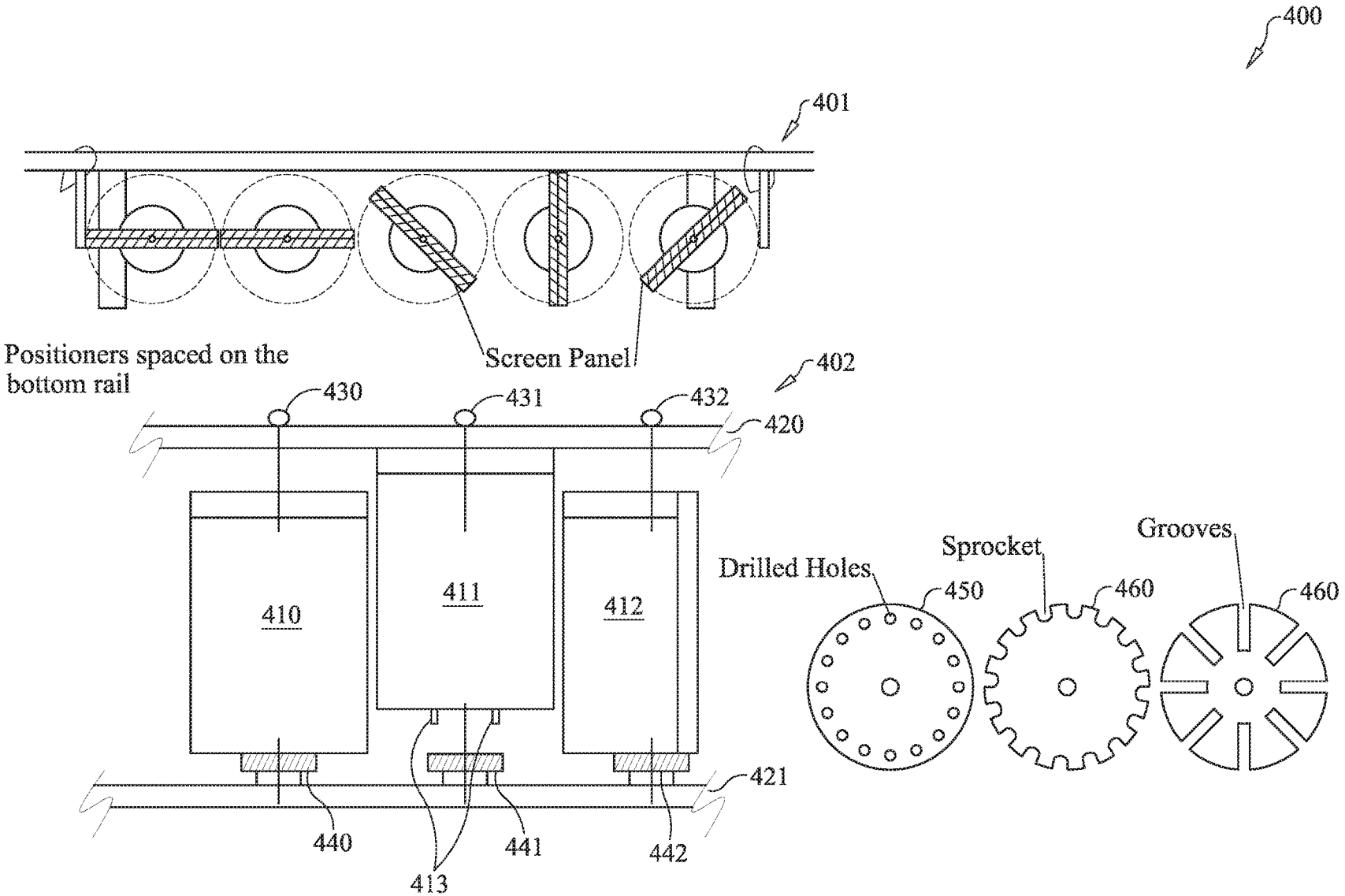
FIG. 4 shows a screening apparatus with different types of locking mechanisms for employment therein, as may be implemented in accordance with one or more embodiments.

A plurality of such screen panels 310 can thus be arranged relative to one another for rotation and screening, such as shown in FIG. 1. The screen panel 310 can be made of various types of materials, and may be both artistic and functional in nature. Further, the panel may be vertically oriented, can operate independently of other such screen panels, and may be configured to rotate a full 360 degrees. Each adjacent panel can be positioned independently of one another via their respective positioner pegs and positioner having positioner guides therein. FIG. 4 shows a screening apparatus 400 with different types of locking mechanisms for employment therein, as may be implemented in accordance with one or more embodiments. The apparatus 400 may, for example, be implemented with characteristics as shown in and described in connection with FIGS. 1 and 3, as shown in top view 401 and front view 402. Respective panels 410, 411 and 412 are coupled to upper (420) and lower (421) rails of a frame via actuators 430, 431 and 432, and positioners 440, 441 and 442. Top views of three different positioner types 450, 460 and 470 are shown, which may be implemented with positioners 440, 441 and 442. Positioner type 450 includes drilled holes, such as for engagement with pins as shown in FIG. 3. Positioner type 460 has gear type structures at a perimeter thereof (e.g., as in a socket), and may be engaged with a corresponding component (pins 413 or other) on the panels for locking therewith. Positioner type 460 has various grooves, which may also engage with corresponding components (pins or others) on the panels for locking.

The positioners as characterized herein may work with the bottom of each screen panel to keep the panel in a stable, non-movable position. The positioner gives the screening apparatus the ability to have independently operating vertical panels, which can be adjusted to set the screening apparatus into a configuration that meets the screening needs of the user. In certain implementations, the positioner facilitates each screen panel to be lifted, spun (e.g., 360 degrees) in either direction, and re-set into another fixed position. The positioner may be affixed to a frame's bottom rail, or flipped vertically with the actuator as shown. The center of the positioner may be utilized as the pivot point and receiver for each panel, such as for a pivot shaft located on the bottom of each panel. Positioner guides within each positioner work with the positioner pegs (or other component) on the bottom of each screen panel to keep it in a fixed position until the screen panel is lifted, rotated and re-set into a different fixed position.

Figure 5A:
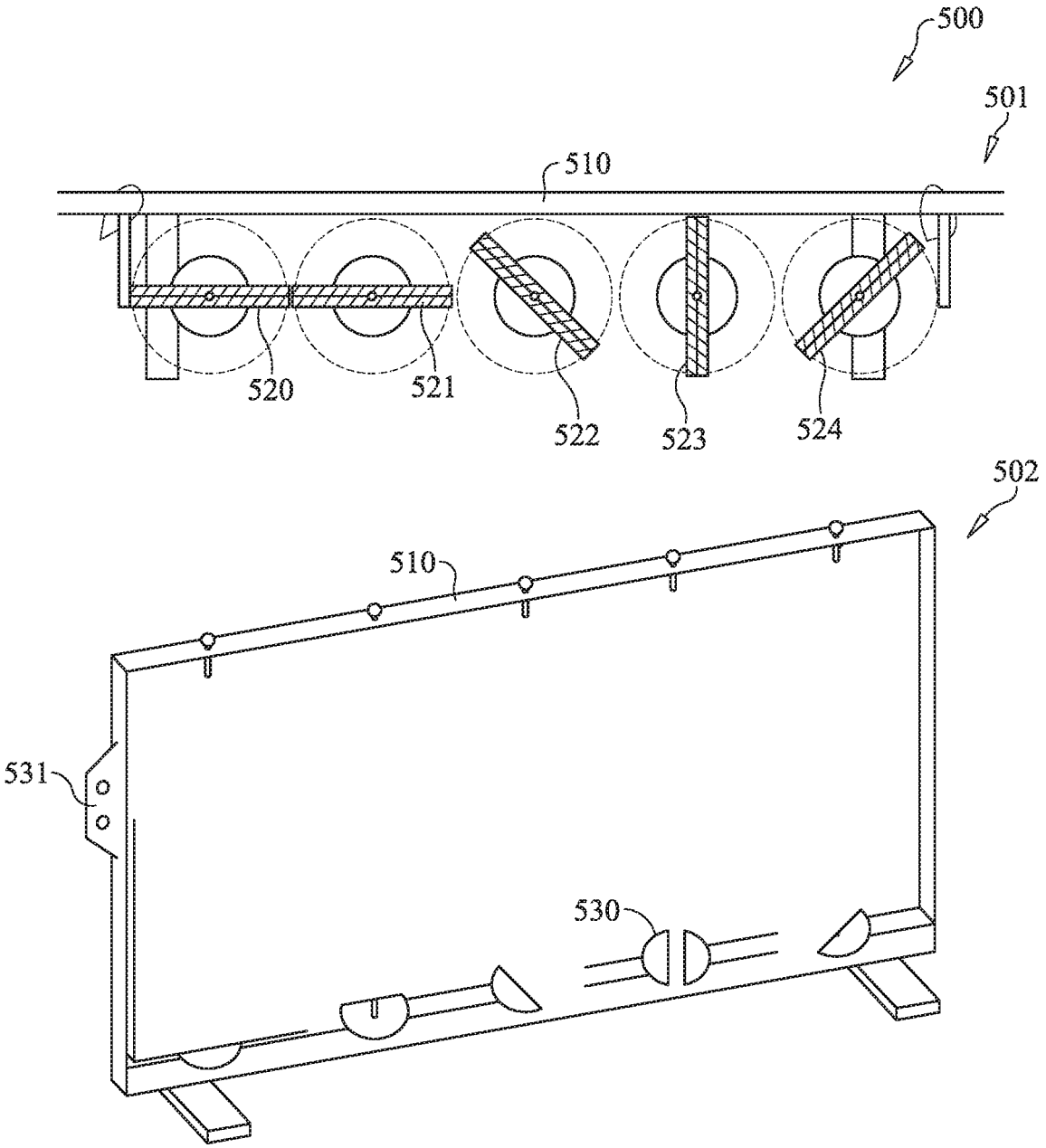
Figure 5B:
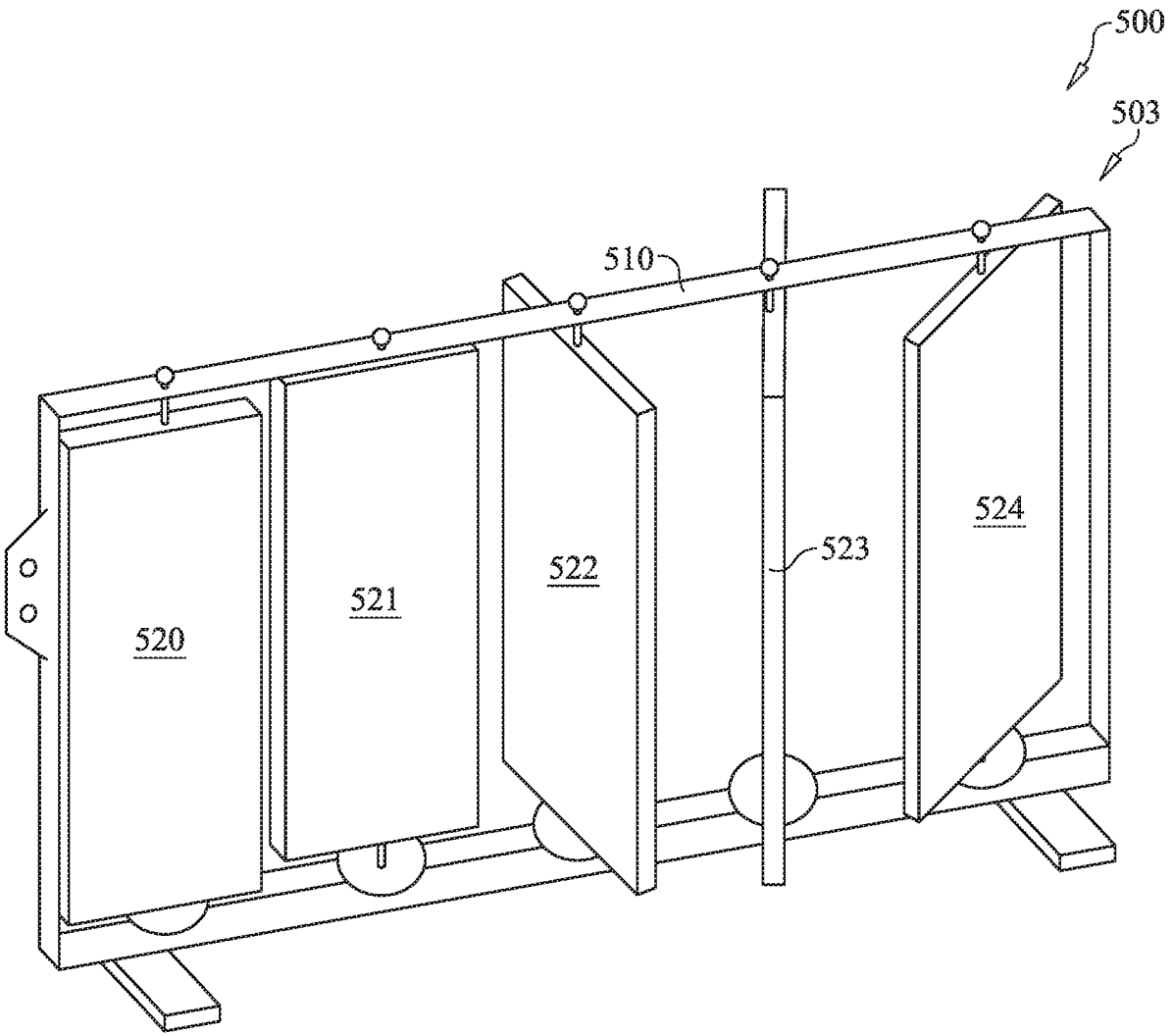

FIGS. 5A and 5B show a screening apparatus 500, in which FIG. 5A shows a frame in top (501) and perspective (502) views, and FIG. 5BV shows a perspective view 503 with panels 520, 521, 522, 523 and 524 in various positions, as may be implemented in accordance with one or more embodiments. The apparatus 500 may be assembled in a variety of manners. Referring to FIG. 5A, a bottom rail of the frame can be positioned with positioners (530 shown by example) coupled to the bottom rail facing up, with the base of the frame on a surface (e.g., and parallel with a guard rail if so used). Vertical stiles can then be attached to the bottom rail with panel guards (531) facing the guard rail. A top rail of the frame can then be attached to the upright styles, completing the frame which can be secured.

Referring to FIG. 5B, a the bottom of each screen panel can be placed with a pivot-shaft end thereof through a pivot shaft receiver located in the middle of the upward facing positioner on the bottom rail. The screen panel can then be tilted upright so a pin receiver on the top of screen panel lines up with a pin pivot guide in the top rail, through which a pin can be inserted and into the pin receiver in the panel. Each screening panel can be individually adjusted as shown to set the apparatus into a screening configuration that meets screening needs.

Figure 6:
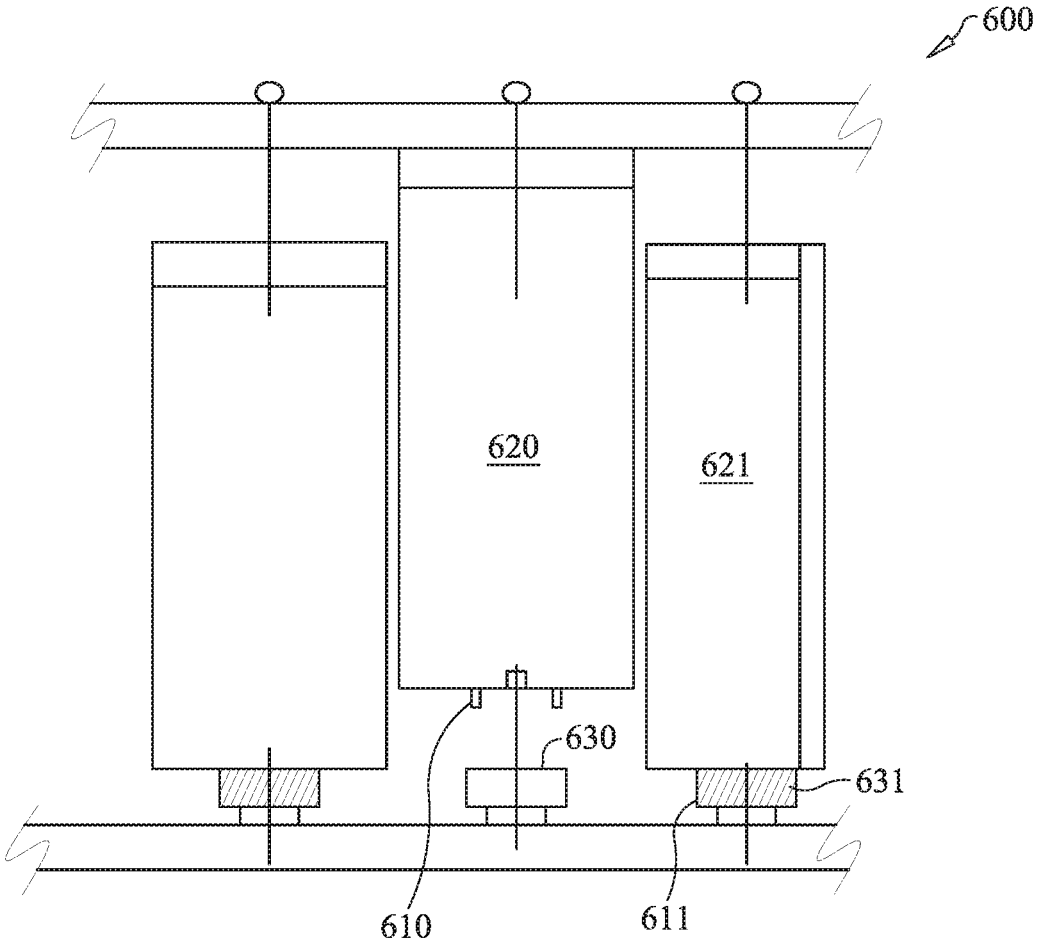
FIG. 6 shows an approach for adjusting panels in a screening apparatus, as may be implemented in accordance with one or more embodiments.

FIG. 6 shows an approach for adjusting panels in a screening apparatus, as may be implemented in accordance with one or more embodiments. At 610, panel 620 is lifted away from its' positioner 630, and can be spun freely. At 611, panel 621 has been spun while lifted and re-engaged with its positioner 631.

Figure 7:
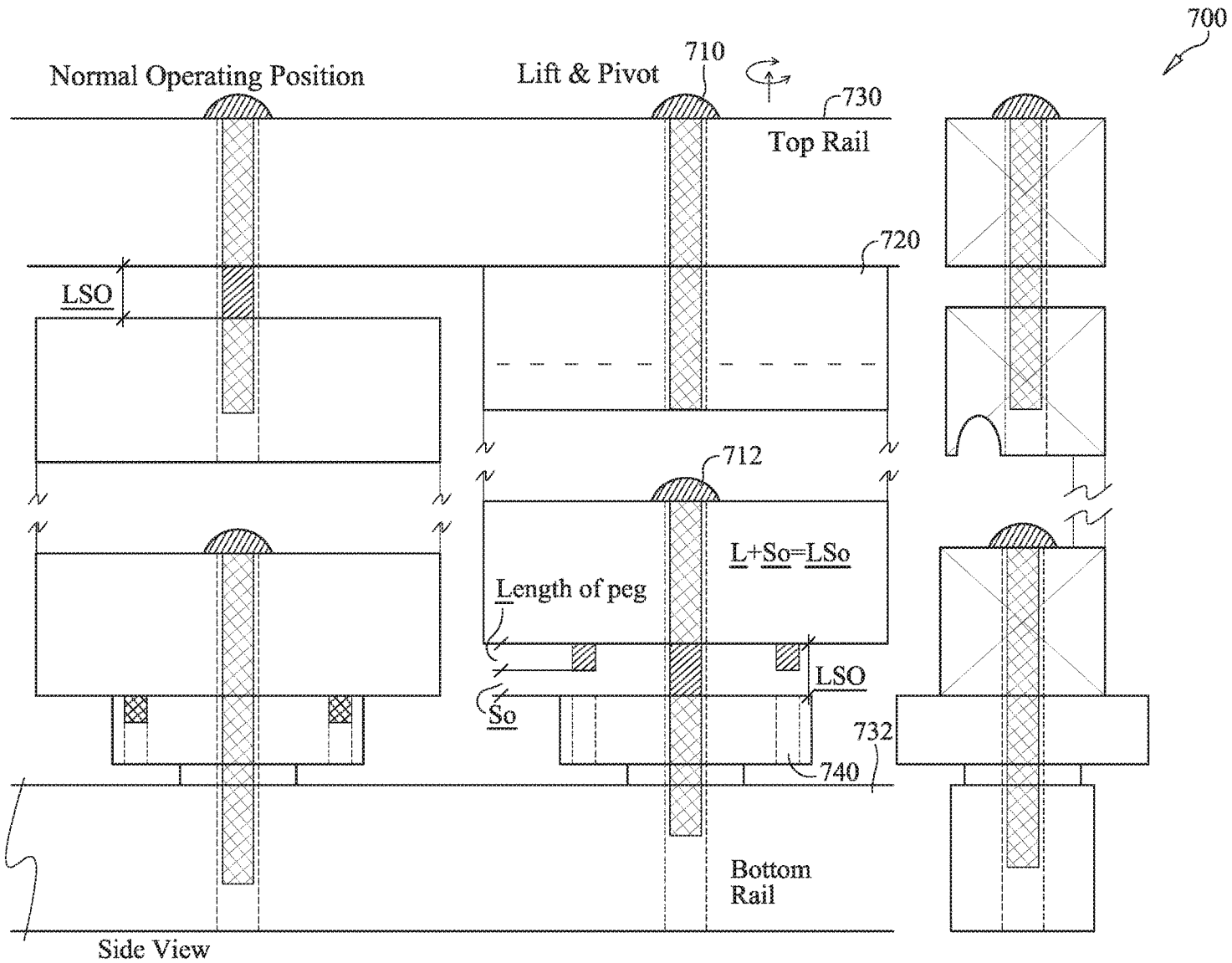
FIG. 7 shows a pin-type structure 700 as may be utilized for securing a screening panel, in accordance with one or more embodiments.

FIG. 7 shows a pin-type structure 700 as may be utilized for securing a screening panel, in accordance with one or more embodiments. A pin 710 can be utilized to secure a screening panel 720 relative to a frame top rail 730, while allowing the screening panel to rotate or lock. A further pin 712 can be utilized to position the screening panel 720 relative to a frame bottom rail 732, and lock via positioner 740 (e.g., with a pin-type locking approach, such as characterized in FIG. 8).

Figure 8:
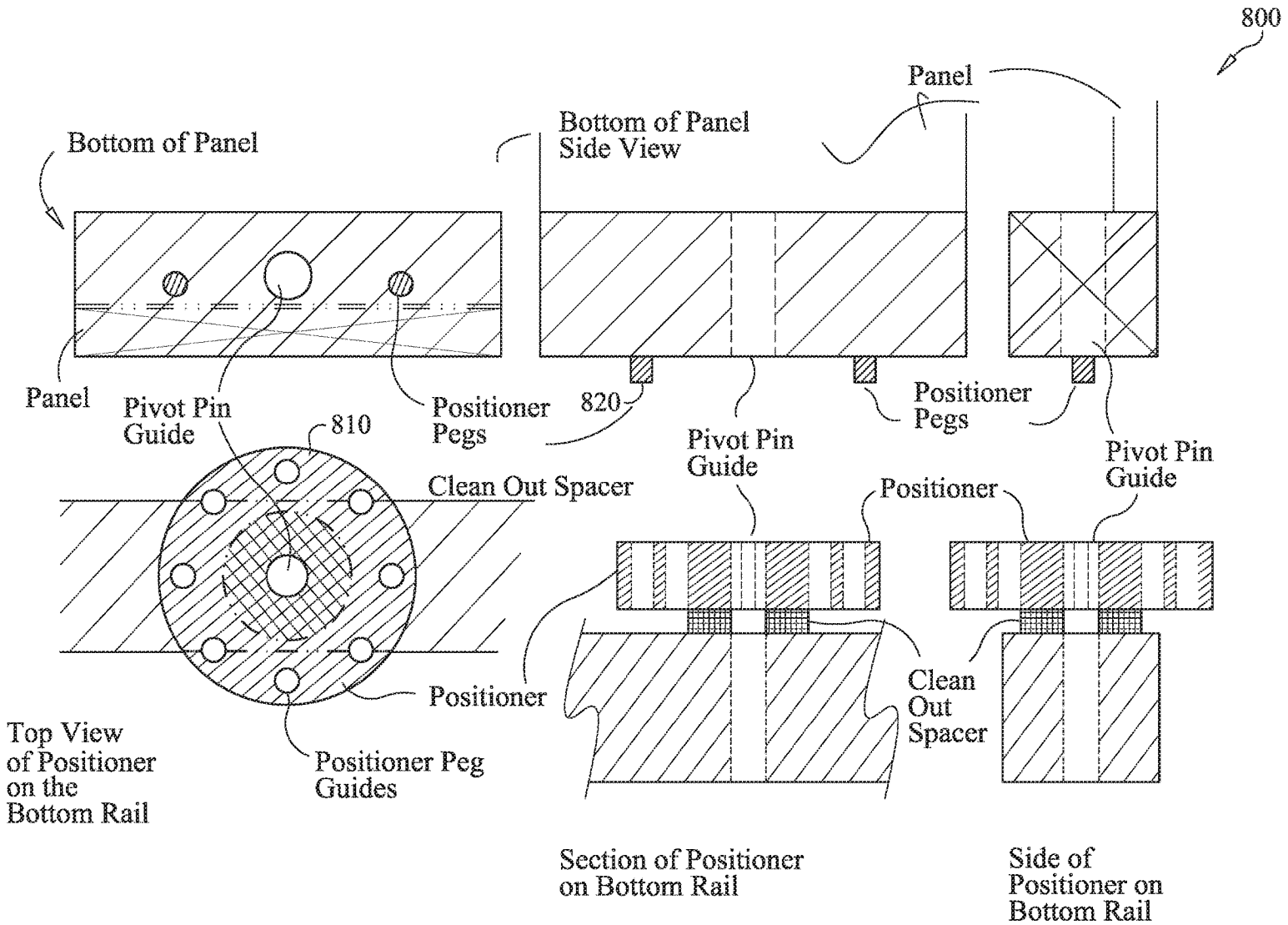
FIG. 8 shows a locking mechanism 800, as may be implemented in accordance with one or more embodiments.

FIG. 8 shows a locking mechanism 800, as may be implemented in accordance with one or more embodiments. The apparatus 800 includes a positioner 810 having a plurality of openings therein, and pin-type structures 820 as may be implemented within a screening panel. Respective section views are shown.

Based upon the above discussion and illustrations, those skilled in the art will readily recognize that various modifications and changes may be made to the various embodiments without strictly following the exemplary embodiments and applications illustrated and described herein. For example, a variety of other types of screening materials, shapes, and components can be used, with the positioning aspects characterized herein. Further, different orientations can be used to suit certain applications, and the screening components characterized herein can be integrated with a variety of different structures. In addition, the various embodiments described herein may be combined in certain embodiments, and various aspects of individual embodiments may be implemented as separate embodiments. For instance, system type structures in the figures can be utilized separately, or combined with other components. Such modifications do not depart from the true spirit and scope of various aspects of the invention, including aspects set forth in the claims.

What is claimed is:

1. An apparatus comprising:

a plurality of panels;

a frame;

for each panel, a locking mechanism coupled to the frame and configured and arranged to lock the panel in place when engaged with the panel, each panel and its corresponding locking mechanism being configured and arranged to lock the panel in place at a different angle of rotation, relative to the other panels;

for each panel, a mechanical actuator connected to the panel and to the frame and configured and arranged with the panel and frame to:

position the panel relative to the frame and offset from the other panels by a distance that is sufficient for adjacent ones of the panels to rotate independently of one another; and in response to the panel being disengaged from the locking mechanism, facilitate rotation of the panel about an axis of rotation that is fixed relative to the frame; and the mechanical actuator and locking mechanism for each panel being configured and arranged to facilitate engaging and disengaging of the panel and the locking mechanism via relative movement between the panel and the locking mechanism, in which movement of the panel and locking mechanism away from one another completely disengages the panel from the locking mechanism, and in which movement of the panel and locking mechanism toward one another directly engages a surface portion of the panel with a surface of the locking mechanism.

2. The apparatus of claim 1, wherein at least one of the locking mechanisms includes a shape feature configured and arranged to engage with a corresponding shape feature of the panel to which it is configured to engage, for locking the position of the panel relative to the locking mechanism.

3. The apparatus of claim 1, wherein each panel is configured and arranged to move respectively toward and away from its locking mechanism via the mechanical actuator connected to the panel for engaging and disengaging with the locking mechanism.

4. The apparatus of claim 1, wherein each locking mechanism is configured and arranged to move toward and away from its panel respectively for engaging and disengaging with the panel.

5. The apparatus of claim 1, wherein each panel and its corresponding locking mechanism are respectively configured and arranged to move toward and away from each other respectively for engaging and disengaging with one another.

6. The apparatus of claim 1, further including a spring for each panel, each spring being configured and arranged to maintain its panel and the corresponding locking mechanism in an engaged position, and to facilitate disengaging of the panel from its corresponding locking mechanism in response to force applied to the spring.

7. The apparatus of claim 1, further including a spring for each panel, the spring being coupled to the frame and configured and arranged to apply a spring force to the panel for engaging the panel with its corresponding locking mechanism, and to facilitate disengaging of the panel in response to the panel being lifted or pushed against the spring.

8. The apparatus of claim 1, further including a spring for each locking mechanism, the spring being coupled to the frame and configured and arranged to apply a spring force to the locking mechanism for engaging the locking mechanism with its corresponding panel, and to facilitate disengaging of the locking mechanism from the panel in response to the locking mechanism being lifted or pushed against the spring.

9. The apparatus of claim 1, wherein each panel is configured and arranged to move vertically along the mechanical actuator connected thereto for engaging and disengaging the panel with the locking mechanism.

10. The apparatus of claim 1, wherein, for each panel, the mechanical actuator includes a shaft along which the panel to which it is connected is configured to move;

the locking mechanism is located adjacent a lower portion of the frame and below the panel; and the panel is configured and arranged to disengage with the locking mechanism in response to being lifted upward along the mechanical actuator for rotation thereof, and to reengage with the locking mechanism and lock in place upon being moved downward along the mechanical actuator and therein engaging with the locking mechanism.

11. The apparatus of claim 1, wherein the respective locking mechanisms for each panel are configured and arranged to engage with and lock its respective panel independent of engaging and locking of the other panels with their respective locking mechanisms.

12. A method of manufacturing an apparatus, the method comprising:

providing a plurality of panels and a frame;

for each panel, coupling a locking mechanism to the frame, the locking mechanism being configured and arranged to lock the panel in place when engaged with the panel, each panel and its corresponding locking mechanism being configured and arranged to lock the panel in place at a different angle of rotation, relative to the other panels; and for each panel, connecting a mechanical actuator to the panel and to the frame, the mechanical actuator being configured and arranged with the panel and frame to:

position the panel relative to the frame and offset from the other panels by a distance that is sufficient for adjacent ones of the panels to rotate independently of one another;

disengaging the panel from the locking mechanism via relative movement between the panel and the locking mechanism, by moving the panel and locking mechanism away from one another and completely disengaging the panel from the locking mechanism;

in response to the panel being disengaged from the locking mechanism, facilitate rotation of the panel about an axis of rotation that is fixed relative to the frame; and locking the panel to the locking mechanism by moving the panel and locking mechanism toward one another to directly engage a surface portion of the panel with a surface of the locking mechanism.

13. The method of claim 12, wherein at least one of the locking mechanisms includes a shape feature configured and arranged to engage with a corresponding shape feature of the panel to which it is configured to engage, for locking the position of the panel relative to the locking mechanism.

14. The method of claim 12, wherein the mechanical actuator and locking mechanism for each panel are configured and arranged to facilitate engaging and disengaging of the panel and the locking mechanism via relative movement between the panel and the locking mechanism.

15. The method of claim 12, wherein, for each panel, the mechanical actuator includes a shaft along which the panel to which it is connected is configured to move;

the locking mechanism is located adjacent a lower portion of the frame and below the panel; and the panel is configured and arranged to disengage with the locking mechanism in response to being lifted upward along the mechanical actuator for rotation thereof, and to reengage with the locking mechanism and lock in place upon being moved downward along the mechanical actuator and therein engaging with the locking mechanism.

16. A method comprising:

for each of a plurality of panels, coupling a locking mechanism to a frame and using the locking mechanism to lock the panel in place when engaged with the panel, including locking different ones of the panels in place at a different angle of rotation, relative to the other panels; and for each panel, connecting a mechanical actuator to the panel and to the frame and using the mechanical actuator with the panel and frame to:

position the panel relative to the frame and offset from the other panels by a distance that is sufficient for adjacent ones of the panels to rotate independently of one another;

engage and disengage panel and the locking mechanism via relative movement between the panel and the locking mechanism, including moving the panel and locking mechanism away from one another to completely disengage the panel from the locking mechanism, and including moving the panel and locking mechanism toward one another to directly engage a surface portion of the panel with a surface of the locking mechanism; and in response to the panel being disengaged from the locking mechanism, facilitate rotation of the panel about an axis of rotation that is fixed relative to the frame.

17. The method of claim 16, wherein locking the position of at least one of the panels includes using a shape feature of the locking mechanism for the at least one of the panels to engage with a corresponding shape feature of the panel and therein locking the position of the panel relative to the locking mechanism.

18. The method of claim 16, further including engaging and disengaging one of the panels and its corresponding locking mechanism via relative movement between the panel and the locking mechanism.

19. The method of claim 16, wherein, for each panel, the mechanical actuator includes a shaft along which the panel to which it is connected is configured to move, and the locking mechanism is located adjacent a lower portion of the frame and below the panel; and further including disengaging one of the panels from its locking mechanism by lifting the panel upward along the mechanical actuator, rotating the panel, and reengaging the panel with the locking mechanism and locking in place by moving the panel downward along the mechanical actuator and therein engaging with the locking mechanism.

* * * * *